US006318540B1

(12) United States Patent
Spatafora

(10) Patent No.: US 6,318,540 B1
(45) Date of Patent: Nov. 20, 2001

(54) METHOD OF FEEDING CIGARETTES TO A HOPPER OUTLET

(75) Inventor: Mario Spatafora, Bologna (IT)

(73) Assignee: G.D. Societa' per Azioni, Bologna (IT)

( * ) Notice: Subject to any disclaimer, the term of this patent is extended or adjusted under 35 U.S.C. 154(b) by 0 days.

(21) Appl. No.: 09/441,132

(22) Filed: Nov. 17, 1999

(30) Foreign Application Priority Data

Nov. 18, 1998 (IT) ..... BO98A0641

(51) Int. Cl.[7] ..... B65G 47/14
(52) U.S. Cl. ..... 198/396; 198/347.1; 198/532
(58) Field of Search ..... 198/347.1, 347.4, 198/550.01, 532, 396, 383, 389, 390

(56) References Cited

U.S. PATENT DOCUMENTS 3,579,953 * 5/1971 Gianese ..... 198/532 X
5,641,073 * 6/1997 Fuchs ..... 198/396 X
6,102,187 * 8/2000 Stimpfl ..... 198/396 X
6,119,842 * 9/2000 Richardson ..... 198/532 X

FOREIGN PATENT DOCUMENTS

3617643 * 12/1986 (DE) ..... 198/532
0 545 724 A 6/1993 (EP) .
1434421 * 5/1976 (GB) ..... 198/347.1

* cited by examiner

*Primary Examiner*—James R. Bidwell
(74) *Attorney, Agent, or Firm*—Marshall, Gerstein, & Borun

(57) ABSTRACT

A method of feeding cigarettes, of a length considerably greater than their diameter, to an outlet of a hopper, whereby masses of cigarettes having a number of orientations are fed to an inlet, and the cigarettes are selected according to orientation by means of the orientation and size of the inlet.

14 Claims, 5 Drawing Sheets

METHOD OF FEEDING CIGARETTES TO A HOPPER OUTLET

The present invention relates to a method of feeding cigarettes to a hopper outlet.

BACKGROUND OF THE INVENTION

For manufacturing and conditioning cigarettes in packets, a type of conditioning machine is known which comprises a hopper having an inlet and a number of outlets, each of which outlets comprises closely-spaced partitions defining channels permitting the passage of one cigarette at a time. Each outlet also has a supporting surface located beneath the bottom ends of the channels and for supporting a layer of cigarettes arranged in an orderly succession and containing a given number of cigarettes.

The cigarettes are normally fed to the inlet in masses in which the cigarettes are substantially equioriented, i.e. oriented parallel to a given direction, and, in the case of filter-tipped cigarettes, with the filters located on the same side. Not infrequently, however, the masses also contain cigarettes oriented differently from the others, on account of the way in which the masses are transferred: either directly on conveyor belts or in boxes on box conveyors which empty the boxes into the hopper inlet. When conveying the cigarettes or emptying the boxes, in fact, it is virtually impossible to prevent some of the cigarettes from working into a position crosswise to said given direction. Such cigarettes are commonly referred to as "askewed" and create serious difficulties inside the hopper by blocking the outlet channels and forming so-called bridges, i.e. supporting structures defined by cigarettes. "Askewed" cigarettes therefore prevent through-flow of the cigarettes inside the hopper and result in stoppage of the entire conditioning machine.

EP-A1-545724 discloses a cigarette hopper having an inlet, a number of outlets, each of which comprises closely-spaced partitions defining channels allowing the passage of one cigarette at a time, and a chamber extending between the inlet and the outlets. The hopper disclosed in EP-A1-545724 also comprises a selecting apparatus, which is arranged inside the chamber and is designed to prevent vane jams of the cigarettes by means of a plurality of curved guides extending from the back to the front of the chamber.

The selecting apparatus disclosed in EP-A1-545724 partially eliminates the cigarettes jamming problems originated by the "askewed" cigarettes; however, this selecting apparatus does not work in an optimal manner owing to the difficulty of repositioning or eliminating the "askewed" cigarettes due to the forces, which act on the "askewed" cigarettes in the middle of the chamber and are due to the weight of the mass of cigarettes arranged in the upper portion of the chamber.

SUMMARY OF THE INVENTION

It is an object of the present invention to provide a method of the above type, designed to eliminate the aforementioned drawbacks.

According to the present invention, there is provided a method of feeding cigarettes to an outlet of a hopper as recited by claim 1.

The present invention also relates to a hopper for supplying cigarettes.

According to the present invention, there is provided a hopper for supplying cigarettes as recited by claim 7.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
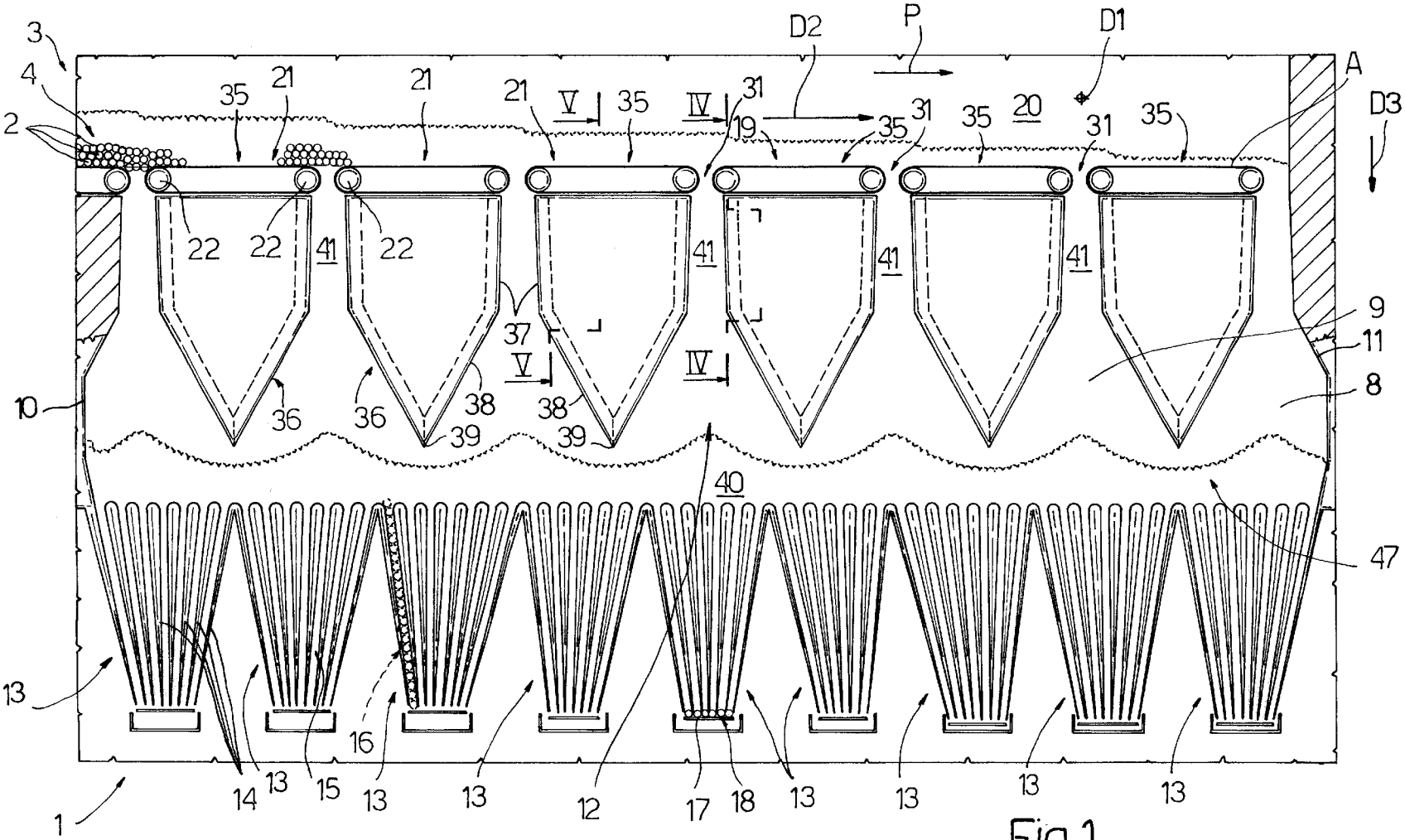
FIG. 1 shows a schematic, partially sectioned front view, with parts removed for clarity, of a cigarette conditioning machine comprising a preferred embodiment of the hopper according to the present invention.

Number 1 in FIG. 1 indicates as a whole a machine for conditioning cigarettes 2 and which comprises a hopper 3 and is connected to a known device (not shown) for supplying masses 4 of cigarettes.

Figure 6:
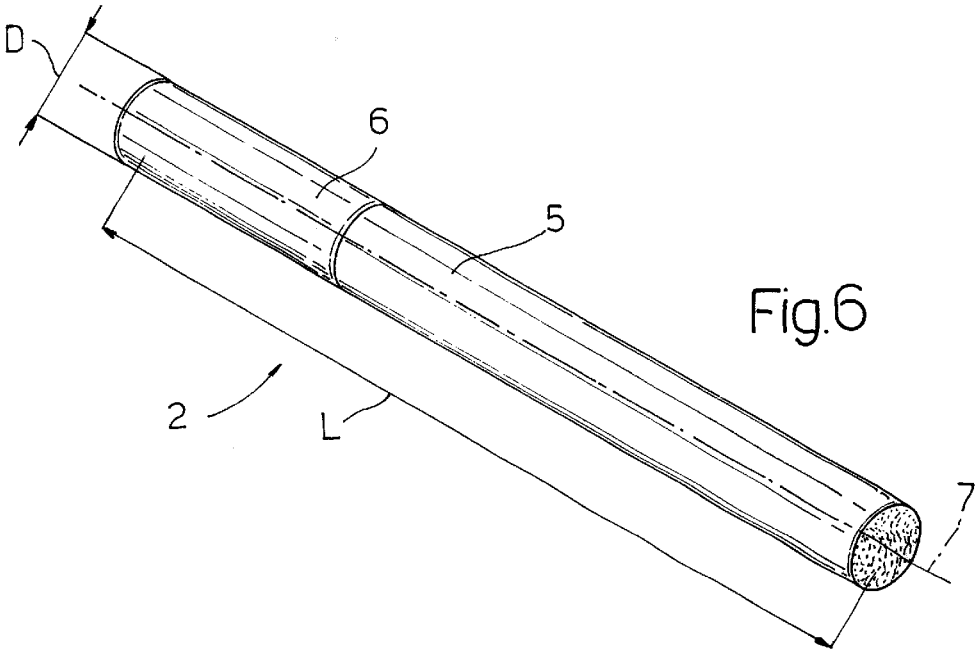
FIG. 6 shows a larger-scale view in perspective of a cigarette.

With reference to FIG. 6, each cigarette 2 comprises a cigarette portion 5 and a filter 6 attached to portion 5; is substantially cylindrical with an axis 7; and has a given diameter D and a given length L equal to roughly thirteen times diameter D.

Hopper 3 houses cigarettes 2 with respective axes 7 parallel to a direction D1 perpendicular to the FIG. 1 plane, and comprises a front wall 8, a rear wall 9 parallel to and separated from wall 8 by a distance approximately equal to but no less than length L of cigarettes 2, and two lateral walls 10 and 11 laterally defining a loading chamber 12 of hopper 3. Hopper 3 also comprises nine outlets 13 defining loading chamber 12 at the bottom of hopper 3; and each outlet 13 comprises a number of partitions 14 perpendicular to the FIG. 1 plane and a given distance apart to define channels 15, each for housing a respective column 16 of cigarettes 2. Each outlet 13 is located over a plate 17 for supporting a layer 18 containing a given number of cigarettes 2 arranged in an orderly succession. Hopper 3 also comprises a conveyor 19 for conveying masses 4 of cigarettes 2 in a horizontal direction D2 parallel to the FIG. 1 plane, and along a given path P. Conveyor 19 defines the top of hopper 3, and comprises two guide walls 20 (only one shown in FIG. 1) and six belt conveyors 21 arranged successively between walls 20.

Figure 4:
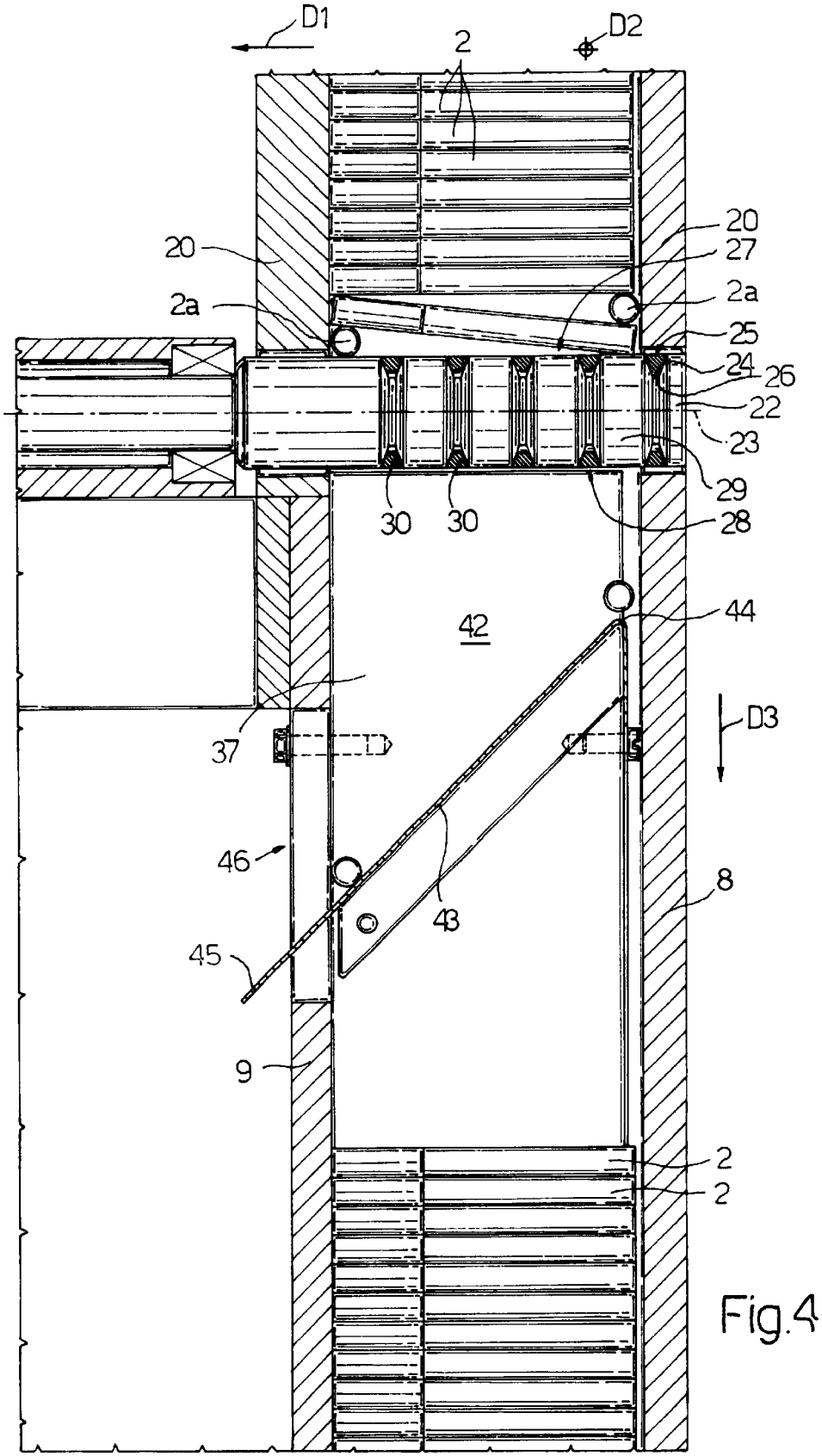
FIG. 4 shows a section along line IV—IV in FIG. 1.

As shown more clearly in FIG. 4, walls 20 are substantially coplanar with front wall 8 and rear wall 9 respectively, and extend in direction D2.

Figure 2:
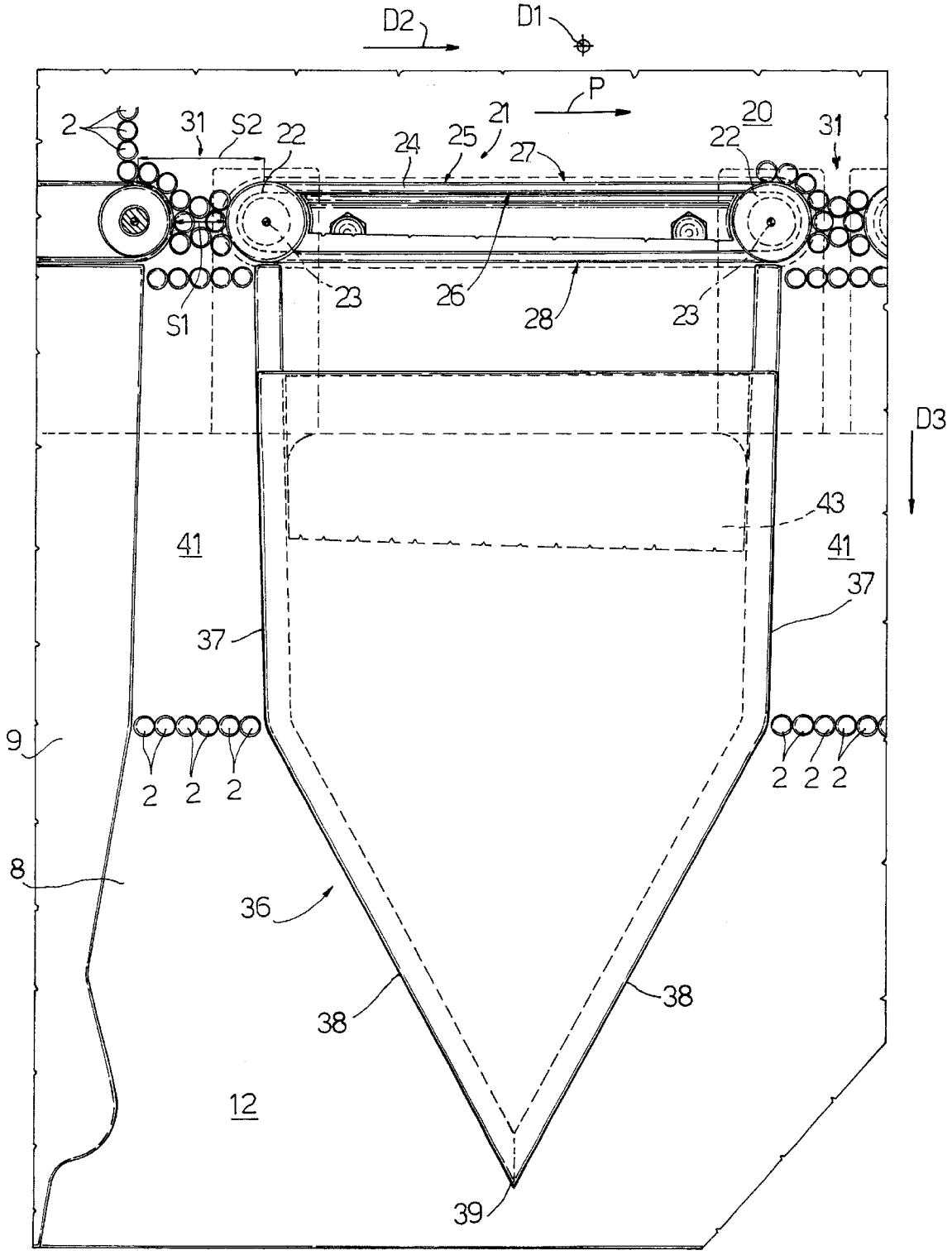
FIG. 2 shows a schematic, partially sectioned, larger-scale front view, with parts removed for clarity, of a detail of the FIG. 1 hopper.
Figure 3:
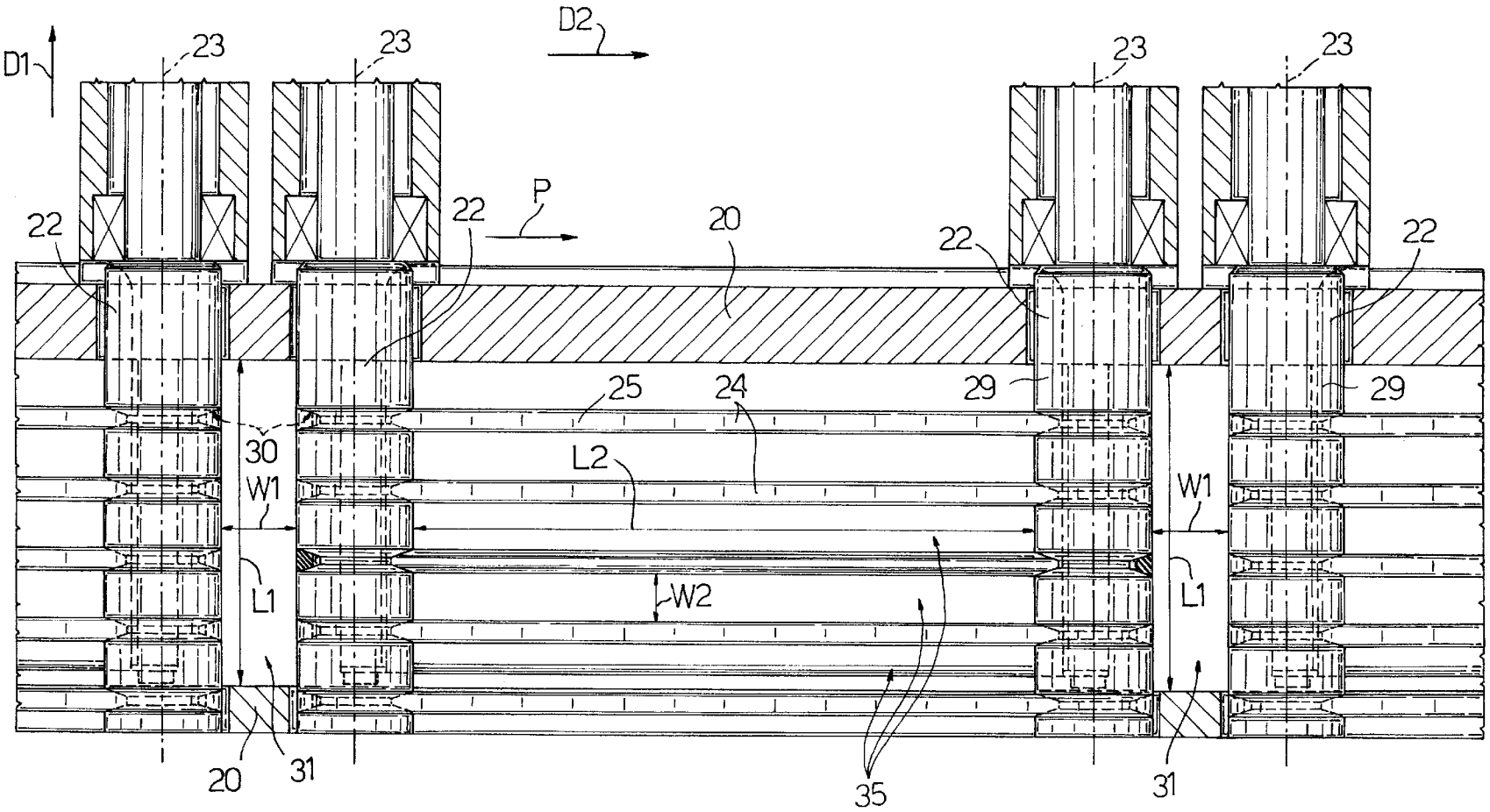
FIG. 3 shows a larger-scale plan view, with parts removed for clarity, of the FIG. 2 detail.

With reference to FIGS. 2 and 4, each conveyor 21 comprises two pulleys 22 rotating about respective axes 23 parallel to direction D1; and a number of trapezoidal belts 24, which have an outer major face 25 and an inner minor face 26, are looped about pulleys 22, and have a top work branch 27 and a bottom return branch 28.

Each pulley 22 comprises a cylindrical outer wall 29 in which are formed a number of trapezoidal-section grooves 30, which extend about axis 23, are equally spaced along axis 23, and house respective belts 24 so that faces 25 of belts 24 are coplanar with wall 29.

The distance, measured in direction D2, between walls 29 of two adjacent pulleys 22 of two successive, adjacent conveyors 21 is equal to roughly three times diameter D of cigarettes 2, so that walls 20 and the adjacent pulleys 22 of two successive, adjacent conveyors 21 define an inlet 31 of hopper 3. Each inlet 31 has a minimum section S1 of length L1 equal to the minimum distance between walls 20, i.e. approximately equal to but no less than length L of cigarettes 2; a width W1 equal to roughly three times diameter D of cigarettes 2, i.e. considerably smaller than length L of cigarettes 2; and a maximum section S2 equal to the maximum distance between walls 29, in turn equal to the distance between axes 23 of the two pulleys 22, i.e. equal to roughly six times diameter D of cigarettes 2.

Figure 5:
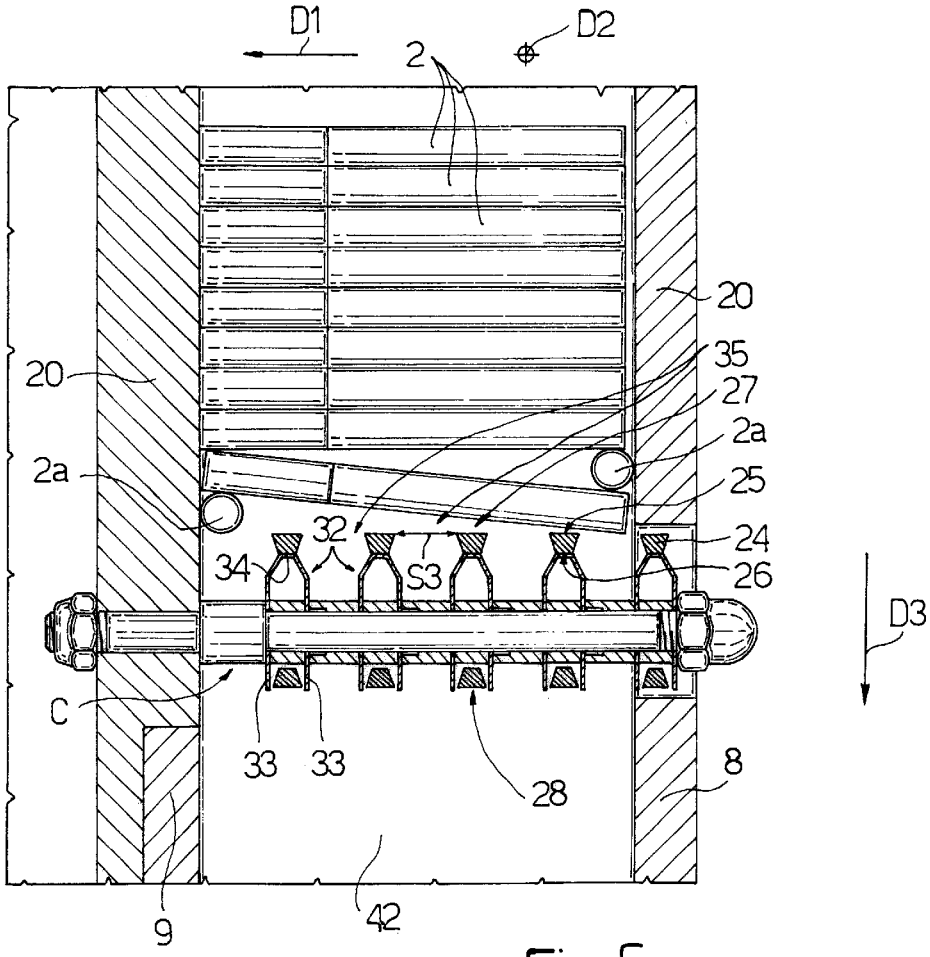
FIG. 5 shows a section along line V—V in FIG. 1.

With reference to FIG. 5, each conveyor 21 also comprises, for each belt 24, a protective casing 32, which extends between the two pulleys 22 and branches 27 and 28, and in turn comprises two lateral wings 33 for guiding belt 24 along bottom branch 28, and a wall 34 for guiding top branch 27 and which is substantially parallel to and facing inner face 26 of belt 24 along top branch 27. Each casing 32 is supported by sleeves C extending between walls 20.

The distance between adjacent belts 24 of the same conveyor 21, and the distance between the end belts 24 and adjacent walls 20 are such that the minimum gap, measured in direction D1, between adjacent belts 24 and between each end belt 24 and the adjacent wall 20 is greater than and substantially equal to twice diameter D of cigarettes 2.

The distance between the axes of the two pulleys 22 of each conveyor 21 is such that the minimum distance, measured in direction D2, between outer walls 29 of said pulleys 22 is greater than length L of cigarettes 2. In other words, walls 20 and belts 24 and pulleys 22 of each conveyor 21 define a number of expulsion inlets 35 for expelling cigarettes 2, and each of which has a minimum section S3 of a length L2 greater than length L of cigarettes 2, and a width W2 equal to roughly twice diameter D of cigarettes 2.

In other words, conveyor 19 defines a horizontal surface A along which inlets 31 to chamber 12 of hopper 12 alternate with expulsion inlets 35.

Hopper 3 also comprises a number of separators 36, each of which is located inside chamber 12, directly beneath a respective conveyor 21, and in turn comprises two substantially vertical walls 37 extending between walls 8 and 9 and aligned with axes 23 of pulleys 22, and two walls 38 sloping with respect to walls 37, extending between walls 8 and 9, and connected to walls 37 and to each other to form a downward-facing cusp 39.

Separators 36 divide chamber 12 of hopper 3 into a chamber 40 extending substantially in direction D2 and located directly over outlets 13; and into a number of channels 41 extending in a vertical direction D3 perpendicular to directions D1 and D2, and which connect respective inlets 31 to chamber 40, and are connected to chamber 40 by walls 38.

Each channel 41 is defined by the adjacent walls 37 of two adjacent separators 36, which walls 37 are separated by a distance smaller than the length L of cigarettes 2. In FIG. 2, the distance between said walls 37 is substantially equal to six times the diameter of cigarettes 2.

With reference to FIG. 4, each separator 36 houses a channel 42 for expelling cigarettes 2 from hopper 3. Each channel 42 is defined by walls 8 and 9 of hopper 3, by walls 37 of separator 36, and by a bottom wall 43, which slopes with respect to the FIG. 2 plane, and has a top end 44 located close to wall 8, and a bottom end 45 extending through an opening 46 formed in wall 9. Channel 42 is located directly beneath a respective conveyor 21, and therefore communicates with inlets 35 of conveyor 21.

The height of chamber 40 is limited by the distance between cusps 39 and the top ends of channels 15 of outlets 13 being equal to roughly ten times diameter D.

In actual use, masses 4 of cigarettes are transferred to hopper 3 and deposited on to conveyor 19 by a known transfer device (not shown). The masses 4 on conveyor 19 comprise cigarettes 2 oriented within a range I1 about direction D1, i.e. either oriented in, or inclined relatively slightly with respect to, direction D1; and cigarettes 2*a* oriented within a range I2 about direction D2. Cigarettes 2*a* are exactly the same size as, and only differ from cigarettes 2 by being oriented differently.

Mass 4 is fed by conveyor 19 along path P in direction D2, so that cigarettes 2 and 2*a* are fed successively over inlets 31 and expulsion inlets 35. The cigarettes 2 located directly over an inlet 31 drop through inlet 31 into respective channel 41 underneath, whereas the cigarettes 2 over inlet 31 but separated from inlet 31 by other cigarettes 2 and/or 2*a* are fed by conveyor 19 to the next inlet 31 and 35. The cigarettes 2*a* located directly over an inlet 35 along path P drop through inlet 35 and are fed by wall 43 through opening 46 into known collecting bins (not shown), whereas the cigarettes 2*a* not directly over inlet 35 are fed to the next inlet 35.

The cigarettes 2 dropping through inlets 31 are guided by respective channels 41, which are so sized as to prevent cigarettes 2 from working into a position parallel to direction D2, and guide cigarettes 2 into chamber 40 where cigarettes 2 form a relatively thin layer 47 of a thickness less than ten times diameter D of cigarettes 2. The cigarettes 2 in layer 47 then drop one at a time into respective channels 15 of outlets 13.

In other words, cigarettes 2 and 2*a* are selected according to orientation, for which purpose, inlets 31 and 35 have respective elongated minimum sections S1 and S3 oriented in directions D1 and D2 respectively. That is, as a function of the orientation of cigarettes 2 and 2*a*, inlets 31 allow cigarettes 2 and deny cigarettes 2*a* access to chamber 12, while inlets 35 allow cigarettes 2*a* and deny cigarettes 2 access to expulsion channel 42.

The method and hopper 3 described afford various advantages, foremost of which is that of preventing cigarettes 2*a* from entering chamber 12 of hopper 3. In which connection, it should be pointed out that it would be far more complicated to eliminate cigarettes 2*a* once inside chamber 12 of hopper 3.

A further advantage lies in channels 41 preventing any variation in the orientation of cigarettes 2 as they are fed down channels 41.

Moreover, the relatively thin layer 47 formed over outlets 13 of hopper 3 prevents the formation of bridges preventing downflow of cigarettes 2.

Clearly, the dimensions of inlets 31 and 35 referred to herein are purely indicative and based on threshold orientation values of cigarettes 2 and 2*a*. That is, a reduction in width W1 of the minimum section of inlet 31 allows the entry of cigarettes 2 oriented practically parallel to direction D1; whereas increasing width W1 also permits the entry of cigarettes 2 which are far from parallel to direction D1 or even oriented at an angle of roughly 45° with respect to D1. The same obviously also applies to the sizing of expulsion inlets 35.

Finally, by appropriately selecting the diameter of pulleys 22, it is possible to achieve a given ratio between the maximum section S2 and the minimum section S1 of inlets 31, and select the cigarettes 2 which can be rearranged without being subjected to excessively severe stress. As such, cigarettes 2 oriented crosswise to direction D1, and which would not drop through minimum section S1, engage the gap between the two pulleys 22, drop through maximum section S2, and are substantially oriented in direction D1 as they drop between the two pulleys 22, the walls 29 of which form curved connections between maximum section S2 and minimum section S1.

What is claimed is:

1. A method of feeding cigarettes to an outlet of a hopper; the cigarettes having a given diameter (D), and a given length (L) considerably greater than said diameter (D); the hopper comprising at least one inlet, and a chamber extending between said inlet and said outlet; the method comprising the steps of supplying said cigarettes in masses to said inlet, the cigarettes in said masses having a number of orientations; selecting said cigarettes as a function of their orientation by means of said inlet; wherein said inlet has a first length (L1) measured in a given first direction (D1) and approximately equal to but no smaller than said given length (L), and a first width (W1) measured in a given second direction (D2) perpendicular to said first direction (D1) and considerably smaller than said given length (L), to permit the passage of first cigarettes oriented within a given first range (I1), and to prevent the passage of second cigarettes oriented within a given second range (I2); the method further comprising the step of expelling said second cigarettes from said masses by means of at least one expulsion inlet adjacent to said inlet; said expulsion inlet having a second length (L2) measured in said second direction (D2) and greater than said given length (L), and a second width (W2) measured in said first direction (D1) and considerably smaller than said given length (L), to permit the passage of the second cigarettes and prevent the passage of the first cigarettes.

2. A method as claimed in claim 1 and further comprising feeding said masses along a given path (P) extending over said inlet and said expulsion inlet.

3. A method of feeding cigarettes to an outlet of a hopper; the cigarettes having a given diameter (D), and a given length (L) considerably greater than said diameter (D); the hopper comprising at least one inlet, and a chamber extending between said inlet and said outlet; the method comprising the steps of supplying said cigarettes in masses to said inlet, the cigarettes in said masses having a number of orientations; selecting said cigarettes as a function of their orientation by means of said inlet; wherein said inlet has a first length (L1) measured in a given first direction (D1) and approximately equal to but no smaller than said given length (L), and a first width (W1) measured in a given second direction (D2) perpendicular to said first direction (D1) and considerably smaller than said given length (L), to permit the passage of first cigarettes oriented within a given first range (I1), and to prevent the passage of second cigarettes oriented within a given second range (I2); said method further comprising the step of distributing said first cigarettes in a relatively thin layer over said outlet; said layer being of a height, measured in a substantially vertical third direction (D3) perpendicular to the first and second direction (D1, D2), equal to a value ranging between three and ten times the diameter (D) of said first and second cigarettes.

4. A method as claimed in claim 3 and further comprising feeding said first cigarettes between said inlet and said layer by means of a substantially vertical channel having a third width, measured in said second direction (D2), smaller than said given length (L).

5. A hopper for supplying cigarettes having a diameter (D) and a given length (L) considerably greater than said diameter (D); the hopper comprising at least one inlet, an outlet, and a chamber extending between said inlet and said outlet; and said hopper inlet being so sized and oriented as to select said cigarettes as a function of their orientation; the hopper further comprising a substantially vertical channel located beneath said inlet; said channel having a third width considerably smaller than said given length (L).

6. A hopper as claimed in claim 5, wherein said channel is defined by two successive adjacent separators, including an expulsion channel being formed in said separator.

7. A hopper supplying cigarettes having a diameter (D) and a given length (L) considerably greater than said diameter (D); the hopper comprising at least one inlet, an outlet, and a chamber extending between said inlet and said outlet; and said hopper inlet being so sized and oriented as to select said cigarettes as a function of their orientation; said hopper further comprising separators housed in said chamber and for reducing the capacity of the chamber.

8. A hopper supplying cigarettes having a diameter (D) and a given length (L) considerably greater than said diameter (D); the hopper comprising at least one inlet, an outlet, and a chamber extending between said inlet and said outlet; and said hopper inlet being so sized and oriented as to select said cigarettes as a function of their orientation; wherein said inlet has a first length (L1) measured in a given first direction (D1) and approximately equal to but no smaller than said given length (L), and a first width (W1) measured in a given second direction (D2) perpendicular to said first direction (D1) and considerably smaller than said given length (L), to permit the passage of first cigarettes oriented within a given first range (I1), and to prevent the passage of second cigarettes oriented within a given second range (I2); the hopper further comprising an expulsion inlet having a second length (L2) measured in said second direction (D2) and greater than said given length (L), and a second width (W2) measured in said first direction (D1) and considerably smaller than said given length (L), to permit the passage of the second cigarettes and prevent the passage of the first cigarettes.

9. A hopper as claimed in claim 1 and further comprising an expulsion channel for expelling the second cigarettes and located beneath said expulsion inlet.

10. A hopper as claimed in claim 8 and further comprising a conveyor for feeding masses of cigarettes along a given path (P); the inlet and the expulsion inlet being located beneath said path (P).

11. A hopper as claimed in claim 10 and further comprising a number of inlets and a number of expulsion inlets; said inlets and said expulsion inlets being located beneath said path (P).

12. A hopper as claimed in claim 11, wherein said conveyor comprises a succession of belt conveyors arranged successively in said second direction (D2) and between two guide walls; said inlets extending between two successive adjacent belt conveyors and said guide walls.

13. A hopper as claimed in claim 11, wherein said expulsion inlets are formed along said belt conveyors.

14. A hopper as claimed in claim 12, wherein each belt conveyor comprises a number of belts separated from one another and from the guide walls and extending about at least two pulleys; said expulsion inlets being defined by said pulleys of the belt conveyor, by the belts and/or by said guide walls.

* * * * *